United States Patent [19]

Florence

[11] 4,377,113

[45] Mar. 22, 1983

[54] ROCKET FIRING SYSTEM

[76] Inventor: John R. Florence, 10 New Rd., Northbourne Bournemouth, England

[21] Appl. No.: 232,846

[22] Filed: Feb. 9, 1981

[51] Int. Cl.[3] ..... F42C 19/12

[52] U.S. Cl. ..... 102/209

[58] Field of Search ..... 102/209, 200; 89/1.807, 89/1.814; 60/256

[56] References Cited

U.S. PATENT DOCUMENTS 2,459,854 1/1949 Swift, Jr. ..... 102/209

*Primary Examiner*—Charles T. Jordan

*Attorney, Agent, or Firm*—Emory L. Groff, Jr.

[57] ABSTRACT

A rocket firing system comprises a magnetic core, a co-axial driver coil and a sensor coil or coils which are connected to a detector device which detects the presence and the desired state of a further coil which is inductively linked to the magnetic core. In use a low-power signal voltage is first applied to the driver coil. Subject to the detector device indicating the presence and desired state of a firing circuit of a rocket including the further coil, an operating power voltage is then applied to the driver coil to induce a firing voltage in the firing circuit.

9 Claims, 3 Drawing Figures

ROCKET FIRING SYSTEM

BACKGROUND OF THE INVENTION

This invention relates to a rocket firing system and to a method of firing a rocket; the rocket firing system is positioned on a launcher device.

It is already known to fire rockets and other pyrotechnic devices by electrical means, in particular using an inductive linkage. However, a complete system for firing rockets should preferably also enable a pre-firing check upon the presence of the rocket, and upon the effectiveness of the firing circuit of the rocket itself. Effective systems embodying these features have not previously been known.

SUMMARY OF THE INVENTION

Accordingly, the invention provides a rocket firing system comprising a magnetic core and a driver coil mounted co-axial therewith, a sensor coil inductively linked with the core and driver coil, and a detector device connected to the sensor coil to determine the state of any further coil brought into inductive linkage with the core. Preferably, the sensor coil is in two parts lying transversely of and closely adjacent the driver coil.

The firing system may be embodied in a rocket launcher device.

Further, the invention provides a method of firing a rocket having an inductive firing circuit adapted to be magnetically linked by a firing system having a magnetic core, a driver coil and a sensor coil, wherein first the core is brought to link magnetically with the firing circuit, then a low-power signal voltage is applied to the driver coil, the presence and state of the firing circuit being monitored by a signal generated in the sensor coil, and thereafter an operating power voltage is applied to the driver coil so as to induce a firing voltage in the firing circuit.

BRIEF DESCRIPTION OF THE DRAWINGS

In order that the invention shall be clearly understood exemplary embodiments thereof will now be described with reference to the drawings in which.

DESCRIPTION OF THE PREFERRED EMBODIMENTS

Figure 1:
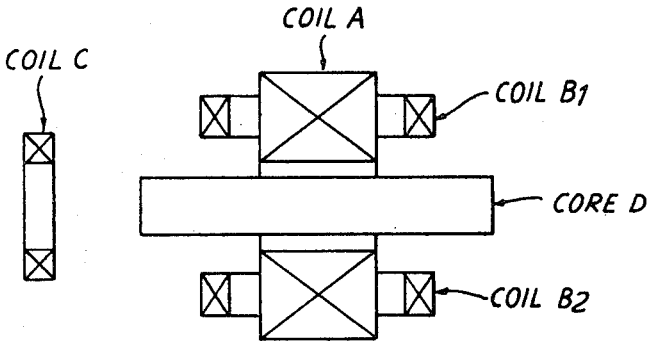
FIG. 1 shows the physical disposition of the components of the firing system according to a first embodiment of the invention.

The firing system of FIG. 1 which is mounted on a rocket launcher comprises in essence a magnetic core D, which is surrounded by a driver coil A. Mounted in close physical proximity to the coil A is a sensor coil B which is divided into two parts $B_1$ and $B_2$. The coil B has its magnetic axis perpendicular to that of coil A and to the core D.

The system is positioned on the launcher such that the core D aligns with a coil C mounted on a rocket positioned in the launcher. The coil C is connected in circuit with a detonator match in the form of a low-voltage, high-current hot wire coil onto which has been deposited a heat sensitive pyrotechnic material. The firing circuit driving coil C has an internal diameter larger than the core D, and when the rocket is in position, the core D enters the coil C and makes an inductive link therewith.

Coil A is connectible to a suitable alternating current supply and which is controlled at two power levels, a low power signal level for testing purposes and a full operating power level for firing. The coil B is connected to a suitable voltage detection circuit. In use, the firing system is set up by moving core D with no rocket present and with the coil A energised at the signal level until the induced voltage in coil B is at a minimum. The core D is then locked in position.

When a rocket is introduced into the launcher, with the signal power voltage applied to the coil A a signal current, well below the safety level of the firing circuit, will flow in coil C. This will result in a major distortion of the magnetic field of coil A and core D. The coil B will detect this change from the normal and the resultant voltage detected by the detection device will indicate the presence of a rocket, and the satisfactory state of the firing circuit on the rocket.

If the rocket is present, but the firing circuit is open-circuited, then no current will flow in the coil C and there will be only minor distortion of the magnetic field when the signal power voltage is applied to coil A.

Figure 2:
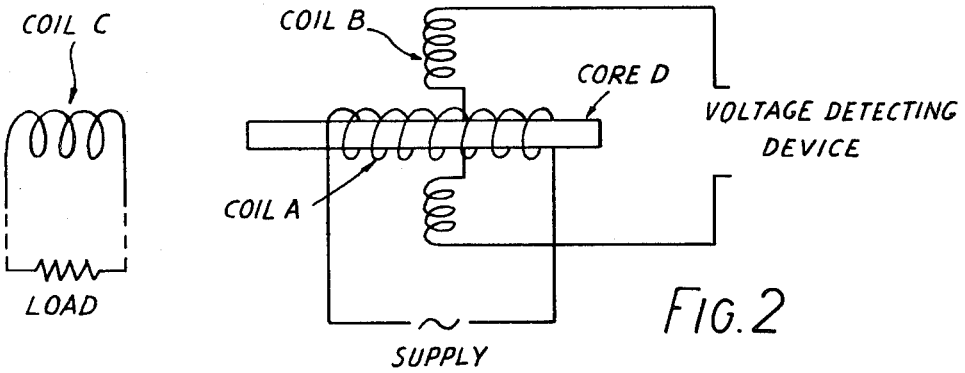
FIG. 2 shows the electrical connections of the firing system of FIG. 1.

In the preferred form shown in FIG. 2, the coil parts $B_1$ and $B_2$ are wound in position, and positioned so that one part will cut more flux than the other when the flux pattern becomes asymetrically distorted by the presence of coil C. This gives a greater sensitivity, and since the signal in coil B is a minimum in the balance of a rocket, allows the use of a threshold detector in the circuit to eliminate external effects. The coil parts are preferably connected in a bridge circuit. A single sensor coil, or one co-axial with the core D, could in theory be used but is very much less sensitive.

Figure 3:
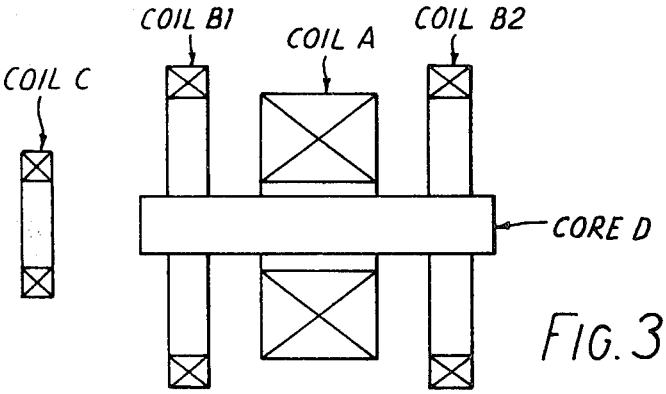
FIG. 3 shows the physical disposition of the components of the firing system according to a second embodiment of the invention.

In another preferred form shown in FIG. 3 two sensor coils coaxial with the core D are used, preferably in a bridge circuit.

Such a firing system is adapted well to being applied to a series of launchers, and testing and firing can be carried out remotely, either sequentially or in unison.

It will be understood that the above description of the present invention is susceptible to various modification changes and adaptations.

I claim:

1. A rocket firing system comprising a magnetic core, a driver coil, said driver coil being mounted co-axially with said magnetic core, sensor coil means, said sensor coil means being inductively linked with said magnetic core and said driver coil, and a detector device, said detector device being connected to said sensor coil means to determine the state of any further coil brought into inductive linkage with the core.

2. A system as defined in claim 1, wherein said sensor coil means comprises two sensor coils, said sensor coils lying transversely of and closely adjacent to said driver coil.

3. A system as defined in claim 2, wherein said sensor coils are wound and/or positioned asymmetrically so that when a said further coil is brought into inductive linkage with said core, one of said sensor coils cuts more flux than the other said sensor coil.

4. A system as defined in claim 1, wherein said sensor coil means comprises two sensor coils, said sensor coils being co-axisl with said driver coil.

5. A system as defined in claim 2, or claim 4, wherein said sensor coils are connected in a bridge circuit.

6. A system as defined in claim 1 wherein said driver coil is connected to an alternating current supply, said supply being switchable to at least two power levels.

7. A method of firing a rocket, said rocket having an inductive firing circuit, said firing circuit being adapted to be magnetically linked by a firing system, said firing system comprising a magnetic core, a driver coil and a sensor coil, the method comprising the steps of bringing the core to link magnetically with said firing circuit, applying a low-power signal voltage to said driver coil, monitoring the presence and state of said firing circuit by a signal generated in said sensor coil, and thereafter applying an operating power voltage to the driver coil to thereby induce a firing voltage in said firing circuit.

8. A method as defined in claim 7 and further comprising setting up said firing system before said core is brought to link magnetically with said firing circuit, the setting up of said firing system comprising the steps of applying said low-power signal voltage to said driver coil, moving said core until the voltage induced in said sensor coil is at a minimum and then fixing said core in position.

9. A method as defined in claim 7 wherein the presence and desired state of said firing circuit cause an asymmetrical flux pattern relative to said sensor coil.

* * * * *